US005542213A

United States Patent [19]

Freeman

[11] Patent Number: 5,542,213

[45] Date of Patent: Aug. 6, 1996

[54] SLIDING MARINE CLOSURE

[75] Inventor: Arvie E. Freeman, Ophir, Oreg.

[73] Assignee: Freeman Marine Equipment, Inc., Gold Beach, Oreg.

[21] Appl. No.: 330,253

[22] Filed: Oct. 27, 1994

[51] Int. Cl.[6] ..... E05D 15/10

[52] U.S. Cl. ..... 49/221; 49/220; 49/370

[58] Field of Search ..... 49/221, 209, 220, 49/219, 218, 370

[56] References Cited

U.S. PATENT DOCUMENTS

| | | | |
|---|---|---|---|
| 678,407 | 7/1901 | Lee . | |
| 801,439 | 10/1905 | Chenoweth . | |
| 2,157,678 | 5/1939 | Schielke . | |
| 2,714,359 | 8/1955 | Seaver . | |
| 2,876,504 | 3/1959 | Bennett et al. . | |
| 3,334,441 | 8/1967 | Landis et al. | 49/220 |
| 3,392,487 | 7/1968 | Madland et al. | 49/220 |
| 3,660,936 | 5/1972 | Bryson | 49/209 |
| 3,913,267 | 10/1975 | Knippel et al. | 49/220 |
| 4,095,371 | 6/1978 | Knippel | 49/220 X |
| 4,098,022 | 7/1978 | Hesch . | |
| 4,317,312 | 3/1982 | Heideman | 49/220 |
| 4,438,595 | 3/1984 | MacDonald . | |
| 4,543,746 | 10/1985 | Racca . | |
| 4,726,145 | 2/1988 | Rokicki | 49/220 |
| 5,271,181 | 12/1993 | Pietro | 49/220 X |
| 5,280,686 | 1/1994 | Davies . | |

*Primary Examiner*—Philip C. Kannan

*Attorney, Agent, or Firm*—Klarquist Sparkman Campbell Leigh & Whinston, L.L.P.

[57] ABSTRACT

A weatherproof sliding closure such as a window, door or hatch, especially suitable for closing openings in a marine environment, is disclosed. The closure is mounted top and bottom on bearing assemblies via camshafts extending through the closure and rotatably mounted in the assemblies. The bearing assemblies travel along fixed top and bottom guideways to move the closure between open and closed positions with respect to the closure opening. Cam portions of the shafts act against internal portions of the closure itself, serving as cam followers, when the camshafts are rotated in unison in the same direction through operation of a closure handle and drive train interconnecting the camshafts internally of the closure. This causes the closure to shift laterally on its bearing assemblies into sealing engagement with a closure frame defining the closure opening.

21 Claims, 5 Drawing Sheets

SLIDING MARINE CLOSURE

BACKGROUND OF THE INVENTION

1. Field of the Invention

The present invention relates to a sliding closure such as a window, door or hatch especially for use on boats and in other environments where a weather-tight or water-tight seal is desirable.

2. Description of the Prior Art

In environments where moisture is often present, such as on a ship or in a coastal dwelling, inhabitants require doors and windows that are capable of forming weather-tight and/or water-tight seals. Marine and coastal applications further require that the closures be capable of sealing interiors from exposure to salt and operate when corroded.

Bryson U.S. Pat. No. 3,660,936 discloses a window having a weather-tight seal. In Bryson, actuation of a peripheral cable-operated linkage carried in the window sash causes the window to move transversely relative to a window frame, thereby sealing the sash against the frame. The linkage comprises sash-mounted cam follower rollers which engage transversely curved cam slots in cam blocks also carried by the sash and guided by the window frame. When a peripheral cable is actuated by a handle, the slide blocks move both longitudinally and transversely relative to the cam blocks, urged by the cam follower rollers, thereby shifting the window sash transversely relative to the cam blocks and against the frame. However, the cable would be subject to stretching and failure, and debris accumulating in, or corrosion in, the cam slots would interfere with operation of the camming mechanism. Furthermore, the somewhat bulky camming mechanism within the sash requires a wider sash than would otherwise be required.

Lee, U.S. Pat. No. 678,407, discloses a bulkhead door having a plurality of bolts or other attachment mechanisms around the perimeter of the door, such that when the bolts are tightened, the door is brought into sealing engagement with the bulkhead. This invention suffers from the disadvantage that several fasteners must be actuated to seal the door, and such actuators are bulky and visible from the outside.

Therefore, there is a need for a sliding weather-tight and water-tight closure which has a clean appearance, is easy to operate, is reliable, requires little maintenance, operates under extreme weather and moisture conditions, cannot readily be fouled by debris or corrosion, and provides a tight, positive seal.

SUMMARY OF THE INVENTION

The primary objective of the present invention is to provide a sliding closure, i.e. a door, window, hatch or the like, which overcomes the foregoing deficiencies of the prior art and fulfills the foregoing needs. More particularly, objects of the invention are to provide a sliding closure which is readily adaptable to marine or other very wet environments by being optionally either weather-tight, water-tight, or both. Another object is to provide such a closure that can be sealed against its adjacent frame in any position between its full-open and full-closed position as well as in its opened or closed position. Another object is to provide such a closure that includes a simple, efficient, positive-acting sealing mechanism that is operable under extremely corrosive and dirty conditions.

In a preferred embodiment of the invention, a door assembly includes a door panel mounted top and bottom on bearing assemblies that travel along fixed top and bottom rails to move the door panel between opened and closed positions. The door panel is also mounted for limited travel transversely of the bearing assemblies and rails between unsealed and sealed positions with respect to a coaming of the surrounding door frame.

Cam shafts within the door panel include shaft end portions journaled in bearings in the bearing assemblies for rotation about the shaft axes. Cam portions of the cam shaft extend through openings in panel frame members which openings closely surround the cam portions so that the panel frame members act as cam followers.

A cam shaft operating mechanism within the door panel and actuated by a door handle accessible from the outside of the door panel, selectively rotates the cam shafts simultaneously, camming their connected panel frame members, and thus the entire door panel, transversely into a sealing relationship with the coaming of the surrounding door frame. This camming action can take place at any position of closure of the door between its opened and closed position. In addition, the camming action can be selectively applied either moderately to cam the door to a weather-tight position or fully to cam the door to a water-tight position against the surrounding door frame.

The principles of the invention can be applied to either a single sliding door or to double sliding or "french" doors because of the unique arcuate "swinging" movement the cam imparts to the door during its camming action. This swinging movement is utilized in a double sliding door to cam the two doors together in sealing abutment against one another as well as to cam the two doors against the coaming of the surrounding stationary door frame.

The foregoing and other objects, features and advantages of the present invention will become more apparent from the following detailed description, which proceeds with reference to the accompanying drawings.

DETAILED DESCRIPTION OF A PREFERRED EMBODIMENT

Figure 1:
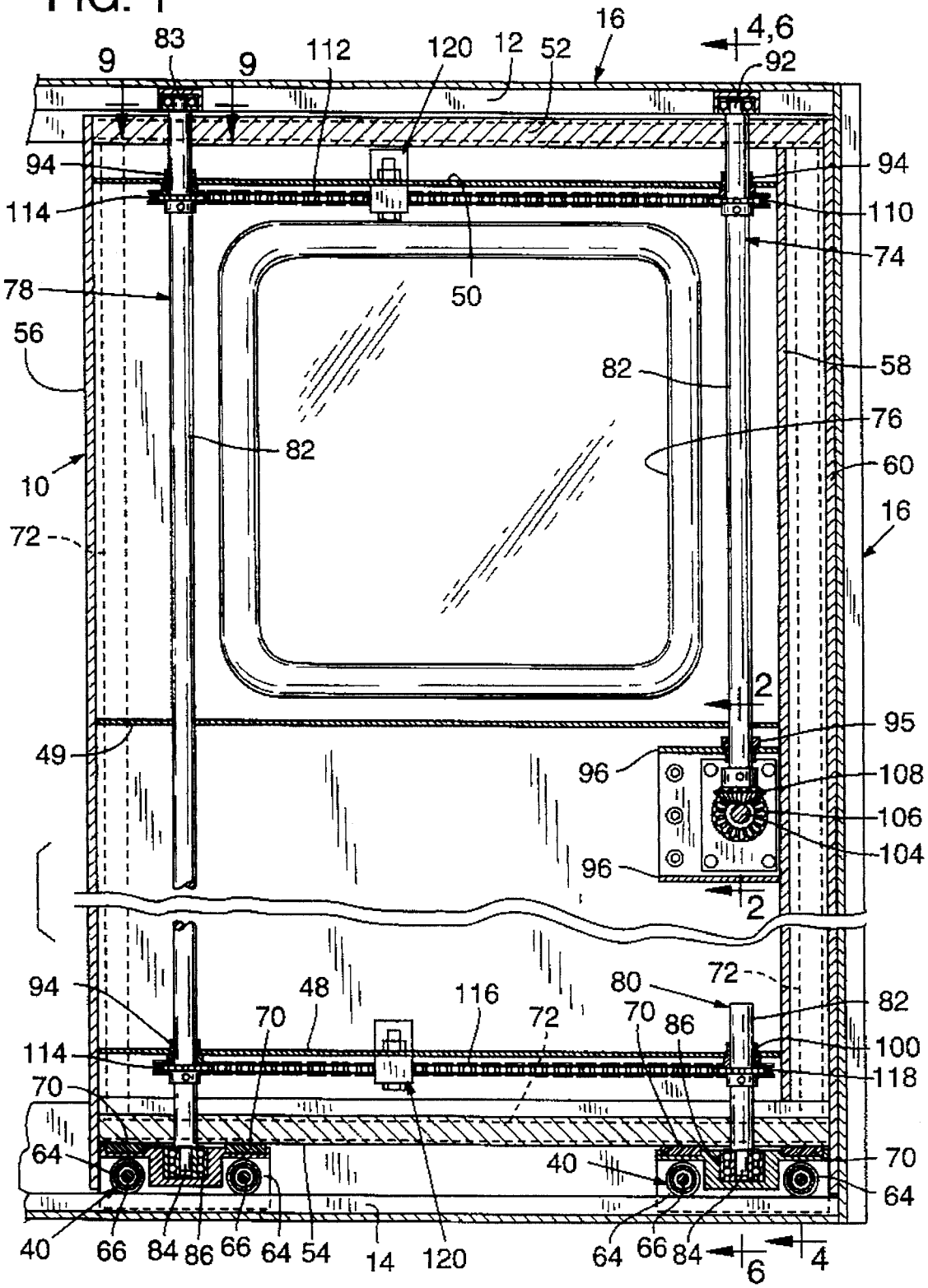
FIG. 1 is a vertical sectional view through a sliding door of the present invention showing the interior of the door, the section being taken in the plane 1—1 of FIG. 2.
Figure 6:
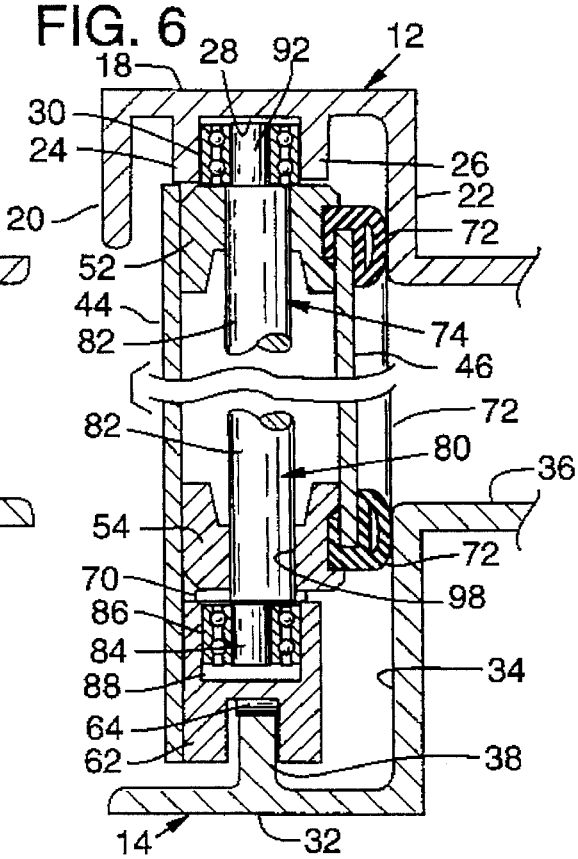
FIG. 6 is a foreshortened cross-sectional view taken along line 6—6 of FIG. 1, also showing the door in a sealed position.

Referring first to FIGS. 1 and 6, a door assembly 10 is mounted for sliding or rolling travel on upper and lower tracks or guideways 12 and 14, respectively, between opened and closed positions, the closed position being shown in FIGS. 1 and 6. The tracks 12, 14 are part of a surrounding stationary door frame 16 that defines the opening within which the door assembly travels.

Figure 4:
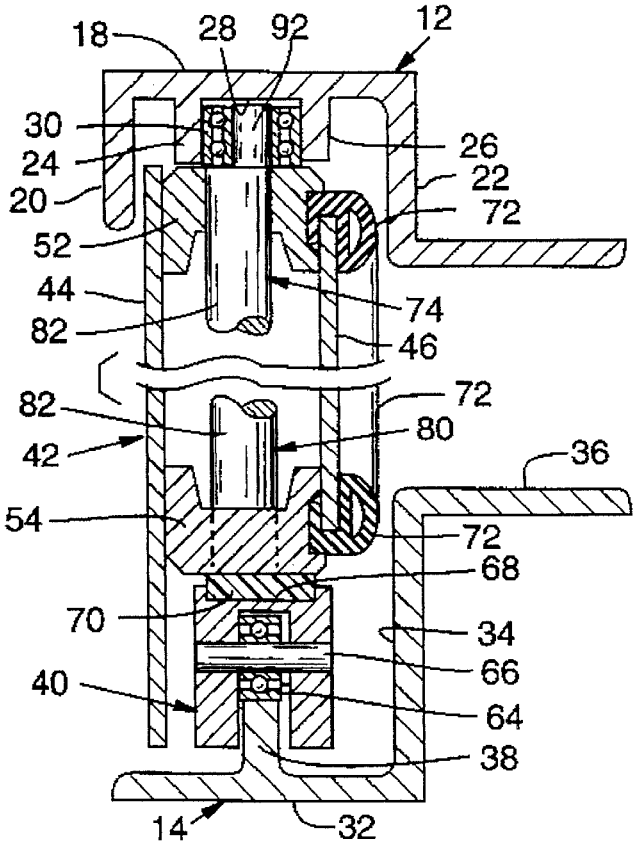
FIG. 4 is a foreshortened cross-sectional view taken along line 4—4 of FIG. 1 showing the door in an unsealed position.
Figure 5:
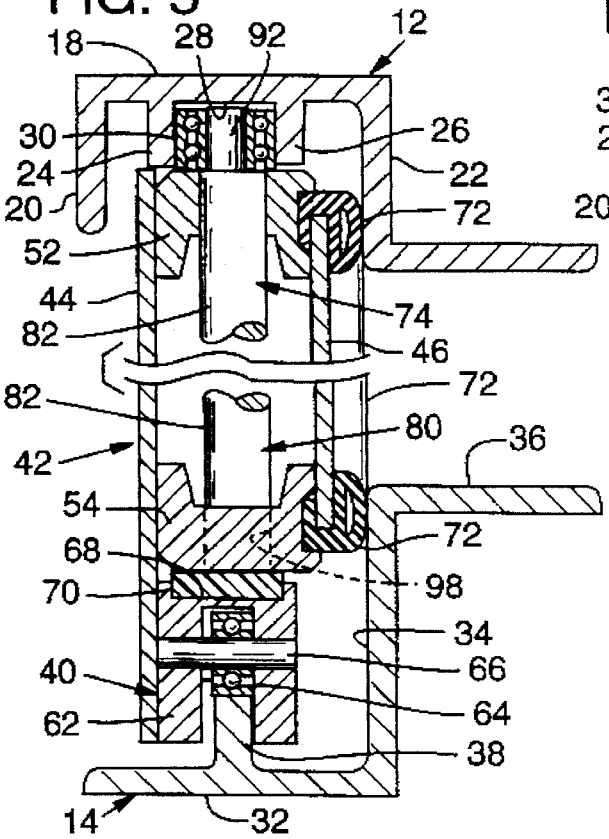
FIG. 5 is a view similar to FIG. 4 showing the door in a weather-tight sealed position.

As more particularly shown in FIGS. 4, 5 and 6, the upper track or guideway 12 includes a horizontal base 18 and, an inner coaming 20 and an outer coaming 22 extending vertically downwardly from the opposite ends of the base to define a generally U-shaped channel within which the upper end portion of the door travels. Within this channel are a pair of parallel flanges 24, 26 extending downwardly from the base and defining a smaller inner bearing channel 28 for slidably receiving a roller bearing assembly 30.

The lower track or guideway 14 includes a base flange 32, a vertical flange or coaming 34 extending upwardly from an outer end of base flange 32, and an upper horizontal flange portion 36 extending horizontally from the upper end of the coaming 34, the base 32, coaming 34 and flange 36 defining a space within which the lower portion of the door assembly travels. A rail flange 38 extends upwardly from a mid-point of the base flange 32 to receive a lower bearing assembly 40 of the door assembly.

Turning now to the door assembly itself, it includes a door panel 42 mounted on upper bearing assemblies 30 and lower bearing assemblies 40. The bearing assemblies 30 and 40, in general, can move only linearly along their respective tracks or guideways 28 and 38, respectively. However, as shown, for example, in FIG. 4, the door panel 42 itself is mounted on the upper and lower bearing assemblies for movement transversely relative to the bearing assemblies and their tracks and also for movement with the bearing assemblies along the tracks.

With reference to FIGS. 1–6, the door panel includes a front panel member 44 spaced apart from a rear panel member 46 by intermediate horizontal panel frame members 48, 49, 50, a top panel cross frame member 52 and a bottom panel cross frame member 54. The top and bottom panel frame members are joined by vertical panel frame members 56, 58 and 60. Panel frame member 56 defines an edge of the door panel and, as shown in FIG. 1, extends downwardly beyond the lower panel frame member 54 to conceal an adjacent lower bearing assembly 40. Similarly, the other vertical panel frame member 60 on the opposite side of the door extends downwardly beyond the lower panel frame member 54 to cover its adjacent bearing assembly 40. Also, the front panel member 42, as shown in FIGS. 4, 5 and 6, extends downwardly below the bottom frame member 54 to cover the lower bearing assemblies 40. Because of the upper and lower coamings 22 and 34, the rear panel member 46 need not extend downwardly past the bottom panel frame member 54 to cover the lower bearing assemblies, since such bearing assemblies are concealed on the rear side of the door anyway. The coamings are used to provide a seal between the door panel and the door frame as will be described in greater detail below.

With reference especially to FIGS. 1, 4, and 5, each lower bearing assembly 40 includes a bearing block 62 of generally inverted U-shape. The legs of the block define a channel therebetween housing a pair of roller bearings 64, each of which is journaled on a shaft 66 carried by the bearing block. Each roller bearing 64 rides on the rail 38.

Figure 7:
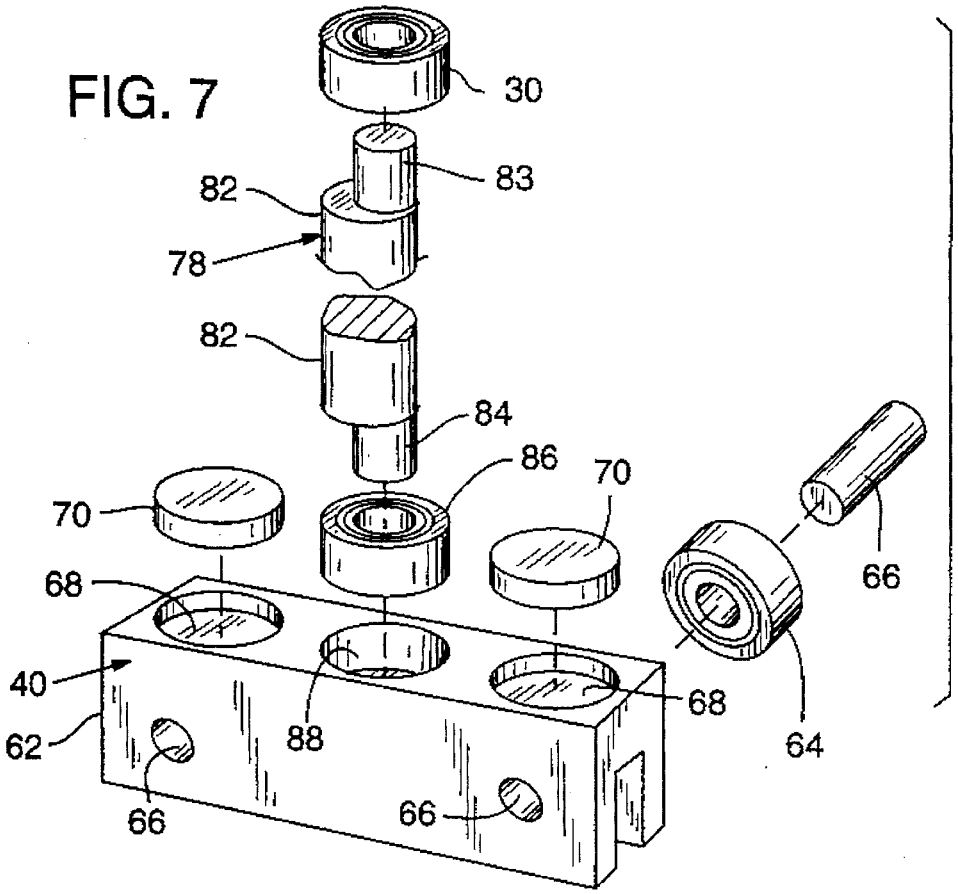
FIG. 7 shows an exploded and foreshortened perspective view of a portion of a cam and cam shaft mounting assembly of the door of FIG. 1.

As shown best in FIG. 7, each bearing block 62 includes a pair of cylindrical recesses 68 near the opposite ends of its top surface. Each recess receives a disc-shaped beating pad 70 of low friction material such as a polycarbonate available from DuPont under the brand name Delrin. The thickness of each bearing pad 70 compared to the depth of each recess 68 is such that the upper portion of each pad extends above the top surface of the bearing block 62 to support the bottom cross frame member 54 of door panel 42, as shown in FIGS. 4 and 5. In this manner the door panel is mounted for transverse movement relative to the upper and lower bearing assemblies as well as for movement longitudinally with the bearing assemblies along the guideways.

Referring again to FIGS. 4–6, the rear panel member 46, together with the rear portion of the upper and lower cross frame members 52, 54, mounts a continuous resilient compressible seal 72 about the rear periphery of the door panel for compression against the upper and lower coamings 22, 34 of the door frame as well as against opposite side coamings (not shown), as illustrated in FIGS. 5 and 6.

The means for moving the door panel 42 both longitudinally with the upper and lower bearing assemblies 30 and 40, respectively, and transversely relative to the upper and lower bearing assemblies into sealing engagement with the door frame comprises a series of interconnected cam shafts, shown in FIG. 1. These cam shafts include a first vertical cam shaft 74 on the right hand side of a window 76 as viewed in FIG. 1, a second longer vertical cam shaft 78 extending from top to bottom of the door panel on the left hand side of the window 76 as shown in FIG. 1 and a third cam shaft 80 at the lower right hand corner of the door panel, much shorter than the other two cam shafts.

Referring to cam shaft 78, each shaft includes a cam portion 82. Cam shaft 78 also includes shaft end portions 83, 84 eccentrically positioned relative to their cam portion 82. Upper shaft portion 83 is journaled in one of the upper roller bearing assemblies 30, and the lower shaft end portion 84 is journaled in a lower roller bearing assembly 86 housed within a recess 88 in the upper surface of one of the lower bearing blocks 62 in the manner shown in FIGS. 6 and 7.

Figure 9:
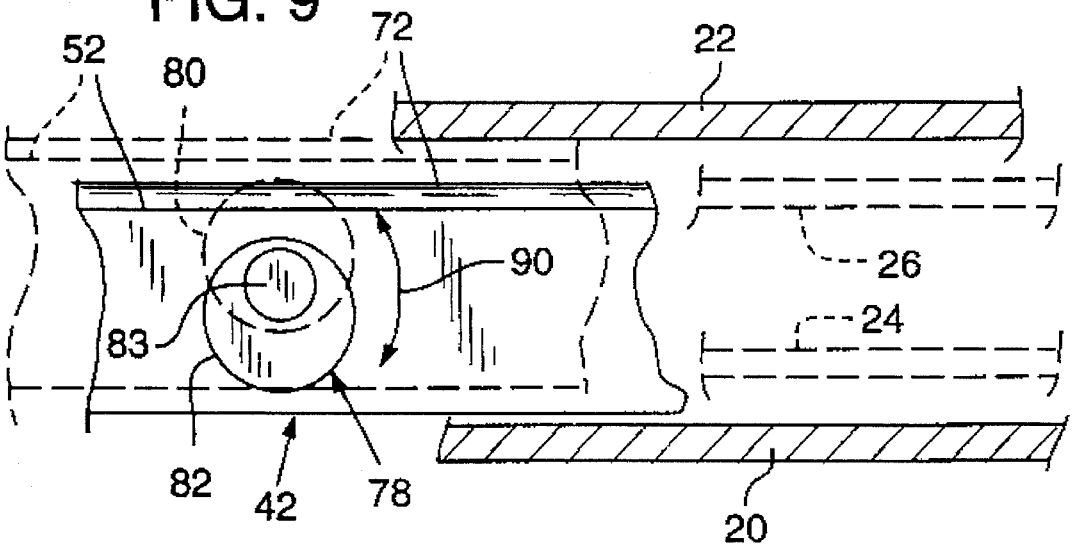
FIG. 9 is a sectional view taken along the line 9—9 of FIG. 1.

The eccentric relationship between the cam portion 82 and the shaft end portions 83, 84 of cam shaft 78 is shown best with reference to FIG. 9. There it will be seen that if cam shaft 78 is rotated in a counterclockwise direction about the axis of the shaft end portions, including end portion 83 about its vertical axis, the cam portion 82 acting against a mating surface of the opening through upper panel frame member 52, pushes the panel frame member 52 and thus its connected door panel, in an arcuate path indicated at 90, transversely. Cam portion 82 is rotated to its dashed line position 80, as is panel frame 52.

The mounting of cam shafts 74 and 80 is similar to that described with respect to the longer cam shaft 78, with one exception. The upper right hand cam shaft 74 in FIG. 1 has a single shaft end portion 92 journaled in its upper bearing assembly 30, as shown in FIG. 4. Its lower end portion is journaled in the manner shown in FIG. 3 in sleeve bearings 94, 95 mounted to cross frame member 50 and an actuator housing 96.

Stub cam shaft 80 has a shaft end portion 84 journaled in a roller bearing assembly 86 within the recess 88 in a lower bearing block 62 as shown in FIG. 6, as previously described with respect to cam shaft 78. Its cam portion 82 extends through a complementary opening 98 in the lower door panel frame 54 as shown in FIG. 6. The upper end portion of stub cam shaft 80 is journaled in a sleeve bearing 100 affixed to intermediate cross frame member 48 as shown in FIG. 1. Thus rotation of stub cam shaft 80 about the axis of the lower shaft end portion 84 in its sleeve bearing cams the door panel transversely relative to the guideways and the plane of the door panel.

Figure 2:
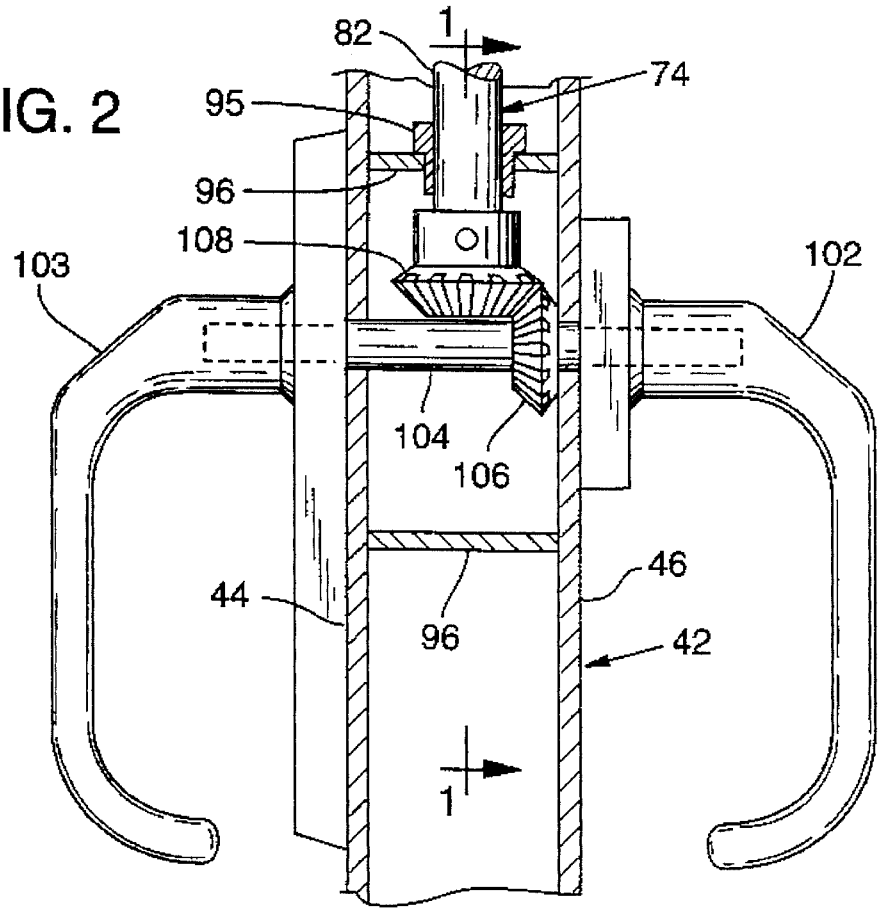
FIG. 2 is a cross-sectional view taken along the line 2—2 of FIG. 1 showing the handle and cam actuator assembly of the door of FIG. 1.

The three cam shafts are rotated simultaneously and in the same direction and to the same extent by an actuating means including the door handles 102, 103 shown in FIG. 2. The two handles are operably interconnected by a shaft 104 which mounts a bevel gear 106 within an actuator housing defined by the two frame members 96 extending between the front and rear door panel members 44, 46. Bevel gear 106 meshes with a bevel gear 108 mounted on the lower end of cam shaft 74.

Figure 3:
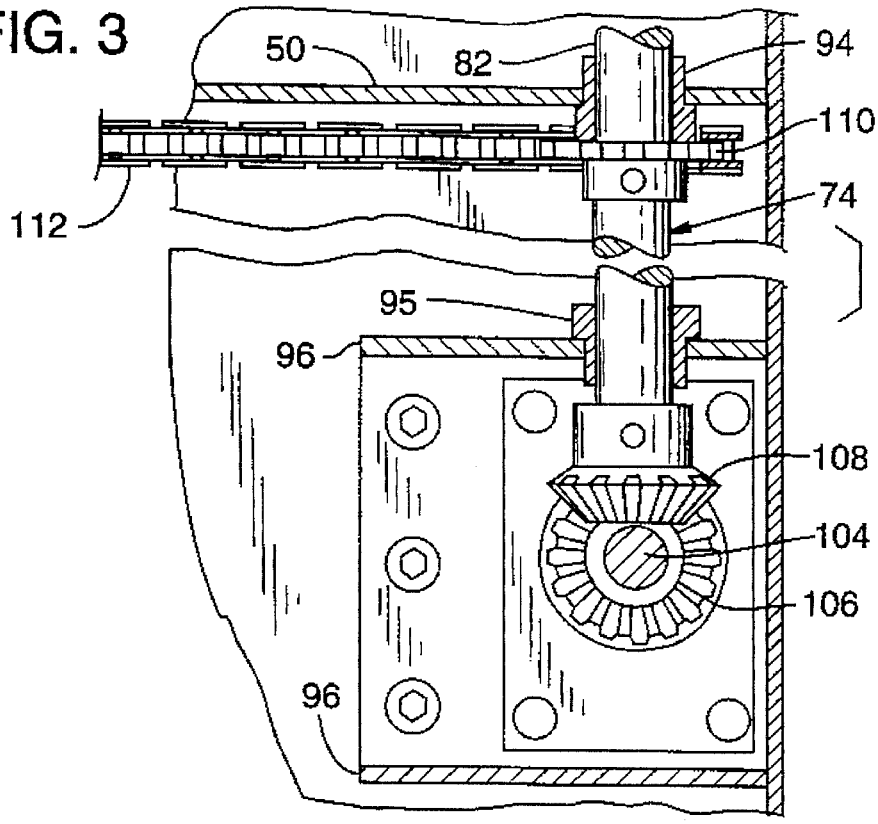
FIG. 3 is an enlarged foreshortened view of the cam actuator assembly and linkage of the door of FIG. 1.

As shown in FIG. 3, an upper portion of shaft 74 mounts a sprocket 110 below intermediate cross frame member 50 and its upper sleeve bearing 94. A drive chain 112 mounted on sprocket 110 is trained about a corresponding sprocket 114 on cam shaft 78 just below a corresponding sleeve bearing 94. Another sprocket 114 on a lower portion of cam shaft 78, just below another sleeve bearing 94 mounting the cam shaft, receives another endless drive chain 116. Chain 116 extends horizontally to another sprocket 118 on stub cam shaft 80 just below its sleeve bearing 100. Upper drive chain 112 and lower drive chain 116 are provided with chain-tightening adjustable turnbuckles 120. These may be adjusted from time to time during the life of the door to take up slack that may occur over time and adjust chain tension as desired.

It will be apparent from FIGS. 1, 2 0and 3 that by rotating either the rear, or inside, door handle 102 or the front, or outside, door handle 103 to various degrees, the cam shafts 74, 78 and 80 will be rotated simultaneously and to the same extent. When so rotated about their axes defined by the axes of rotation of shaft end portions 92, 83, and 84 with their roller bearings, the cam portions 82 of such shafts, acting through their respective sleeve bearings 94, 95, 100 and within the openings through upper and lower door panel frame members 52, 54, urge the door panel transversely as previously described with respect to FIG. 9, to varying extents.

Figure 8:
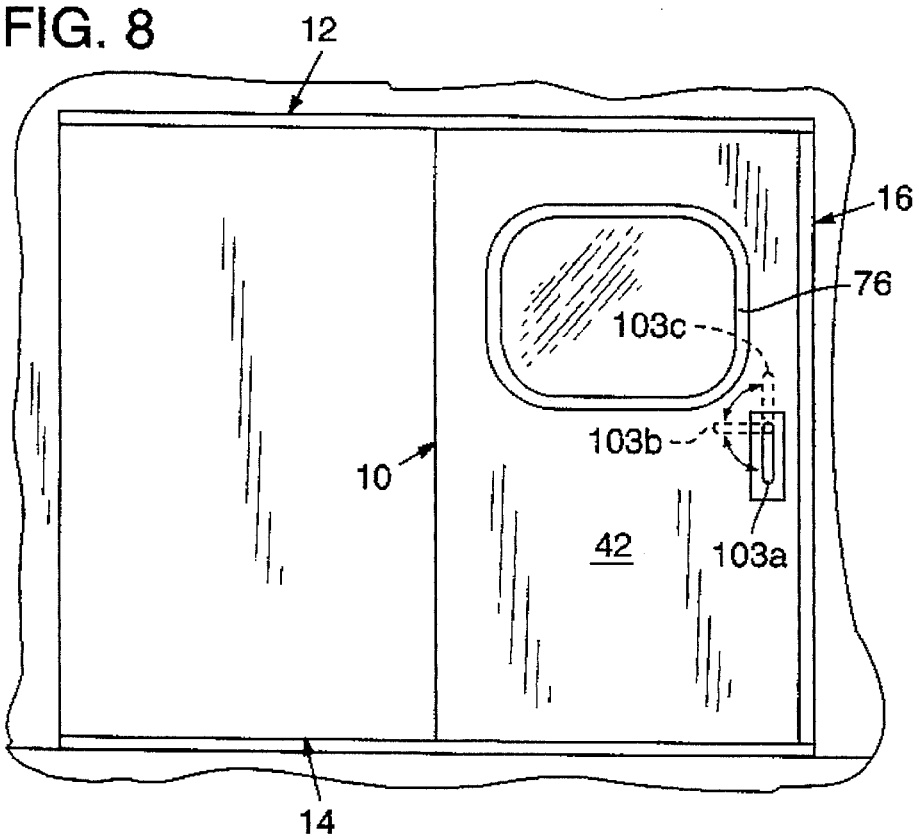
FIG. 8 is a front elevational view of the sliding door of FIG. 1 in its closed and sealed position within a door frame and showing the door latch in various operating positions, two of the positions being shown in phantom.

For example, by rotating a door handle 90 degrees, from an "open" position shown in FIG. 4 wherein the resilient gasket seal 72 is spaced from the coaming 22, 34 of the door frame, to a closed position as shown in FIG. 5 wherein the seal 72 compresses slightly against the coaming, the door is in a "weather-tight" position as shown at 103*b* in FIG. 8. Then, if the door handle is moved further through an additional 90 degrees to the position 103*c* in FIG. 8, the seal is further compressed by further transverse movement of the door panel toward the coaming of the door frame to a "water-tight" position. By rotating the handle through 180 degrees from position 103*c* to position 103*a* counterclockwise, the door is returned to its "open" position as shown in FIG. 4.

Although in FIG. 8 the door panel 10 is shown in its closed position completely covering a door opening, it should be noted that the handle 103 can be rotated to seal the door against the coaming of the door frame at any position of the door within the door opening.

The difference between a weather-tight and a water-tight seal is the level of moisture protection provided by the seal. A greater compression of the seal allows less moisture to pass through the door assembly. However, obtaining a water-tight seal requires additional force on the seal and exerts additional stress on components of the door panel assembly and, door frame. When a weather-tight seal is sufficient for a particular need, the user may prefer not to unduly stress the door, as would be acquired to obtain a water-tight seal, in order to increase the service life of the door panel assembly. Additionally, less force is required to open and close a door with the door in a weather-tight condition as opposed to a water-tight position.

In the preferred embodiment, access to internal door actuating mechanisms described for maintenance is accomplished by removing either the front or rear panel member 44, 46 of the door panel assembly 42. Conventional tools may be used to accomplish the removal of the panel members.

The tension of actuating chains 112, 116 may be set and regulated to take up slack that may occur over time.

Figure 10:
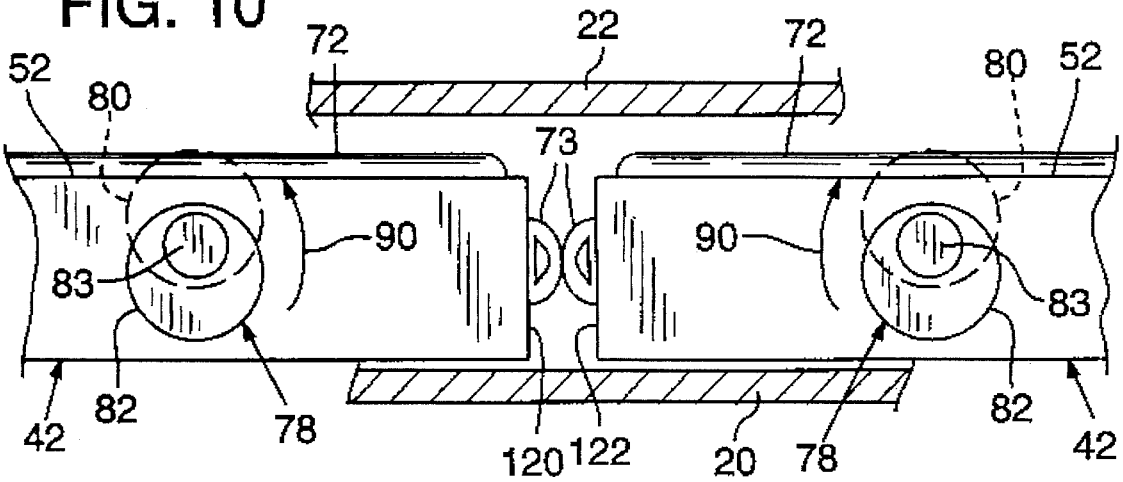
FIG. 10 is a schematic sectional view showing the opposing ends of a double-sliding door according to the invention and illustrating how the cam-actuation of the doors causes them to seal against each other and the adjacent door frame.
Figure 11:
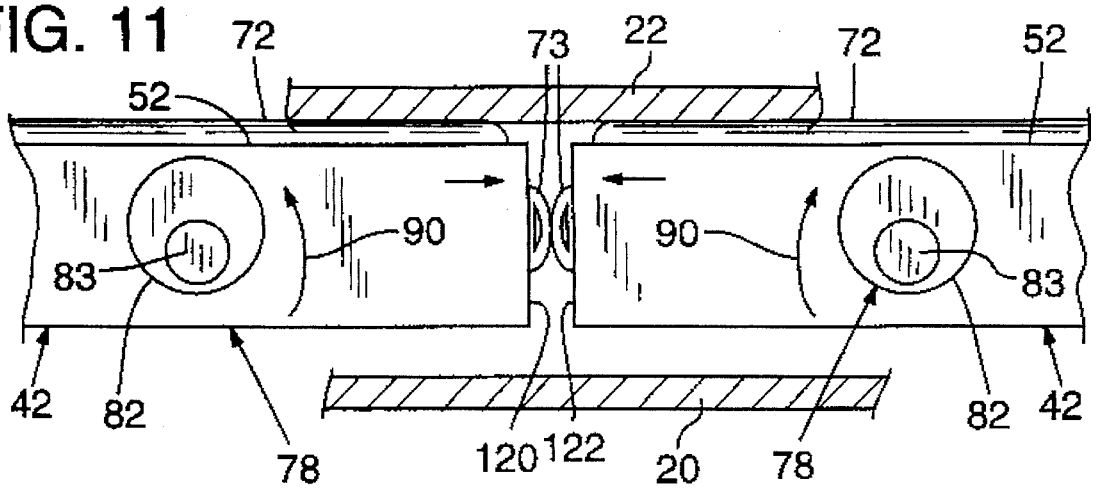
FIG. 11 is a view similar to FIG. 10 showing the double doors in their sealed position

FIGS. 10 and 11 disclose a "double" or "French" door version of the door panel 42 previously described. Two door panels 42 are slidable in the same top and bottom guideways. Only the front coaming 20 and rear coaming 22 of the top guideway are shown in FIGS. 10 and 11. A gasket seal 73 of the left-hand door 42 of FIGS. 10 and 11 is mounted on an edge 120 of the door in opposition to a gasket seal 73 on an opposing edge 122 of the right-hand door panel 42. These edge seals are in addition to the peripheral face seals 72 provided on the face of the rear panel member of each door.

Each door panel 42 has the same construction and operating mechanisms as previously described with respect to door panel 42 of FIGS. 1–9, including the top panel frame members 52 and cam shafts 78 with cam portions 82 and cam shaft end portions 83 journaled in roller bearings (not shown) slidable in the top guideway.

To seal the two doors 42 together and against the door frame coamings 22 in a weather-tight or water-tight condition, the doors are first slid together in edge-abutting relationship as shown in FIG. 10. Then the door handle of each door is rotated to rotate the respective cam shafts 78. The cam shaft of the left door 42 is rotated counterclockwise, while the cam shaft of the right door is rotated clockwise, as viewed in FIGS. 10 and 11. This action cams their respective doors 42 along arcuate paths 90, both toward one another to compress together the edge seals 73. It also cams the two doors toward the door coaming 22 to compress the face seals 72 against coaming 22 of the door frame. Thus the camming action seals the two doors together in edge abutting relationship and seals the two doors against the door frame in one movement of the door handles.

Having illustrated and described preferred embodiments of the invention, it should be apparent to those skilled in the art that the principles of the invention will apply to various modifications in arrangement and detail, and to equivalents, without departing from such principles. I claim as my invention all such modifications and equivalents as come within the true spirit and scope of the following claims.

What is claimed is:

1. A closure assembly for a closure opening defined by a closure frame, comprising:

(a) a first, elongate, linear guideway comprising one side of the closure frame;

(b) a second, elongate, linear guideway parallel to the first guideway and comprising an opposite side of the closure frame;

(c) a bearing assembly movably engaged with the first guideway for longitudinal movement therealong, the first guideway restraining the bearing assembly against substantial lateral movement relative to the first guideway;

(d) a closure mounted on the bearing assembly for longitudinal movement therewith and for lateral movement relative to the bearing assembly;

(e) a cam shaft including a cam portion rotatably engaging the closure as a cam follower, and a shaft end portion journaled in the bearing assembly such that axial rotation of the shaft in the bearing assembly causes the cam portion to move the closure on the bearing assembly laterally relative to the first and second guideways into sealing engagement with the closure frame.

2. The closure assembly of claim 1 including a second bearing assembly movable along the second guideway and wherein the cam shaft extends through the closure and is journaled at its opposite ends in said bearing assemblies movable along the first and second guideways but not substantially in a direction laterally of the guideways.

3. The closure assembly of claim 1 wherein the closure assembly further includes a plurality of said cam shafts each having a cam portion rotatably engaging the closure as a cam follower and a shaft end portion journaled in a bearing assembly movable along but not substantially laterally of one of the first and second guideways, the cam shafts being coordinated so that their simultaneous rotation in the same direction causes movement of the closure laterally of the guideways.

4. The closure assembly of claim 3 wherein the plurality of cam shafts are operatively connected together for simultaneous axial rotation.

5. The closure assembly of claim 4 wherein one of the plurality of cam shafts is operatively connected to a handle such that operation of the handle causes the operatively connected cam shafts to rotate axially simultaneously.

6. The closure assembly of claim 1 further including a plurality of cam shafts each including a cam portion rotatably engaging the closure as a cam follower and each including a shaft end portion journaled in a bearing assembly within one of said first and second guideways, said cam shafts including a first cam shaft operatively connected to an actuation device on the closure wherein operation of the actuation device axially rotates the first shaft, a second cam shaft operatively connected to the first cam shaft such that axial rotation of the first cam shaft axially rotates the second cam shaft, and a third cam shaft operatively connected to the second cam shaft such that axial rotation of the second cam shaft axially rotates the third cam shaft.

7. The closure assembly of claim 6 wherein the first camshaft has one end portion journaled in a bearing assembly movable along the second guideway and an opposite end portion journaled within the closure, the second camshaft has one end portion journaled in a bearing assembly movable along the second guideway and an opposite end portion journaled in a bearing assembly movable along the first guideway, and the third camshaft has one end portion journaled in a bearing assembly movable along the first guideway and an opposite end portion journaled within the closure.

8. The closure assembly of claim 1 wherein the bearing assembly includes a load-bearing low-friction slide bearing element engaging the closure on the bearing assembly to reduce friction when the closure moves laterally with respect to the bearing assembly and first guideway.

9. The closure assembly of claim 8 wherein the bearing element is a low-friction polymer.

10. The closure assembly of claim 1 wherein there are a pair of said closures, each movable along the same first and second guideways, each closure being mounted by a separate said camshaft on a separate said bearing assembly for movement along the first guideway and for movement laterally of its associated bearing assembly for sealing engagement with the closure frame upon rotation of the camshaft.

11. The closure assembly of claim 10 wherein each closure includes a peripheral face seal on a face thereof facing a surface of the closure frame and an edge seal along an edge thereof facing an opposing edge of the other closure, the cam portions of the camshafts of the pair of closures being operable upon rotation of the camshafts in opposite directions to urge the closures in arcuate paths toward each other and toward the surface of the closure frame such that the closures are moved both into edge-to-edge sealing abutment with one another and into face-sealing abutment with the surface of the closure frame.

12. The closure assembly of claim 1 wherein the cam portion of the camshaft when rotated urges the closure in an arcuate path laterally on the bearing assembly into sealing engagement with the closure frame.

13. The closure assembly of claim 1 wherein the camshaft includes a second shaft end portion journaled within a second bearing assembly movable along the second guideway, the second guideway restraining the second bearing assembly against substantial lateral movement.

14. The closure assembly of claim 1 wherein the first guideway comprises a rail and the bearing assembly comprises a bearing block and a roller bearing rollably mounting the block on the rail, the block including a low-friction closure-engaging surface opposite the rail for enabling transverse movement of the closure on the bearing block.

15. The closure assembly of claim 14 wherein the camshaft end portion is journaled in the bearing block.

16. The closure assembly of claim 15 wherein the camshaft end portion is journaled in a roller bearing carried by the bearing block.

17. The closure assembly of claim 14 wherein the bearing block has an inverted channel shape with the roller bearing mounted within a channel defined by the block, the channel having a width sufficient to receive the rail, the low-friction closure-engaging surface comprising a replaceable low-friction pad mounted within recess of a closure-facing surface of the block, the closure-facing surface further including a bearing recess and a roller bearing within the bearing recess for axially removably mounting the camshaft end portion.

18. The closure assembly of claim 1 wherein the closure includes spaced-apart front and rear panel members joined by cross-frame members to define an interior space within the closure, the camshaft extending within the interior space and the cam portion extending through at least one of the cross-frame members such that the cross-frame member serves as a cam follower for the cam portion.

19. The closure assembly of claim 18 wherein multiple said camshafts extend within said interior space, each shaft having an end portion journaled in a bearing assembly in one of the guideways and each shaft having a cam portion in operative cam-follower engagement with a cross-frame member of the closure, all of the camshafts being operatively interconnected within said interior space so that rotation of one camshaft in a predetermined direction rotates the other camshafts in the same direction to shift the closure transversely relative to the guideways.

20. A closure assembly for a closure opening defined by a closure frame, comprising:

(a) a closure;

(b) a cam shaft extending within the closure, the shaft including a cam portion engaging the closure as a cam follower, and a shaft end portion extending beyond the closure;

(c) a bearing assembly;

(d) the frame including a guideway mounting the bearing assembly for longitudinal movement therealong and restraining the bearing assembly from substantial lateral movement; and (e) the shaft end portion being journaled on the bearing assembly for rotation about the axis of the cam shaft to mount the closure on the bearing assembly for longitudinal movement with the bearing assembly along the guideway and for lateral movement on and relative to the bearing assembly.

21. The closure assembly of claim 20 wherein the closure is a door, the guideway extends along beneath the bottom of the door, the bearing assembly is a load-bearing bearing assembly, the bottom of the door engages the bearing assembly, and the bearing assembly includes a low-friction surface portion in direct contact with the door to enable lateral movement of the door on the low-friction surface portion upon rotation of the cam shaft.

* * * * *